US010982486B1

(12) United States Patent
Avant

(10) Patent No.: US 10,982,486 B1
(45) Date of Patent: Apr. 20, 2021

(54) AEROSOL REDUCTION SYSTEM

(71) Applicant: Sondra LaVelle Avant, Ormond Beach, FL (US)

(72) Inventor: Sondra LaVelle Avant, Ormond Beach, FL (US)

( * ) Notice: Subject to any disclaimer, the term of this patent is extended or adjusted under 35 U.S.C. 154(b) by 0 days.

(21) Appl. No.: 16/885,518

(22) Filed: May 28, 2020

(51) Int. Cl.
*E06B 7/02* (2006.01)
*F24F 7/007* (2006.01)
*A47H 23/10* (2006.01)

(52) U.S. Cl.
CPC ..... *E06B 7/02* (2013.01); *A47H 23/10* (2013.01); *F24F 7/007* (2013.01); *E06B 2007/023* (2013.01)

(58) Field of Classification Search
CPC ..... E06B 7/02; E06B 2007/023; A47H 23/10; F24F 7/007
USPC ..... 454/200
See application file for complete search history.

(56) References Cited

U.S. PATENT DOCUMENTS 2,277,072 A * 3/1942 Cohn ..... A61G 10/04 128/204.15
3,345,996 A * 10/1967 Sadove ..... A61G 10/005 600/21
3,348,890 A * 10/1967 Trexler ..... A61G 10/005 312/3
4,939,803 A * 7/1990 Waters ..... A47C 7/66 5/113
5,012,852 A * 5/1991 Blackhurst ..... A61G 15/10 160/351
5,314,377 A * 5/1994 Pelosi, III ..... F24F 3/161 454/187
6,227,600 B1 * 5/2001 Chen ..... B60J 1/2047 296/97.2
2004/0141320 A1 * 7/2004 Bock ..... G01N 21/87 362/253
2005/0085686 A1 * 4/2005 Yuen ..... A61G 10/005 600/21
2005/0170770 A1 * 8/2005 Johnson ..... H05K 7/20736 454/184
2018/0360274 A1 * 12/2018 Fields ..... A47K 3/38

* cited by examiner

*Primary Examiner* — Steven B McAllister
*Assistant Examiner* — Allen R Schult
(74) *Attorney, Agent, or Firm* — RC Trademark Company

(57) ABSTRACT

According to some embodiments, an aerosol reduction system is disclosed. The aerosol reduction system comprises an electric air cleaner that includes a fan. The system further comprises a plurality of disposable curtains circumscribing the electric air cleaner that create an airtight seal with the air cleaner. Each of the plurality of disposable curtains defines a window opening. The system further comprises a window disposed on a window mount and the window create an airtight seal with the window opening.

15 Claims, 7 Drawing Sheets

AEROSOL REDUCTION SYSTEM

BACKGROUND

Pathogens, such as the novel coronavirus (COVID-19) may be spread through aerosols and respiratory droplets that are expelled from a person's mouth or nose when an infected person talks, coughs or sneezes. For medical personnel such as, but not limited to, doctors, dentists, morticians, hygienists, and nurses, that are required to come in close contact with patients or bodies as part of their jobs, the risk of contamination is great. Therefore, a system to protect medical personnel from aerosols and respiratory droplets is desirable.

SUMMARY

Some embodiments described herein relate to an aerosol reduction system. The aerosol reduction system comprises an electric air cleaner. The system further comprises a plurality of disposable curtains circumscribing the electric air cleaner that create an airtight seal with the air cleaner. Each of the plurality of disposable curtains defines a window opening. The system further comprises a window disposed on a window mount and the window creates an airtight seal with the window opening.

DETAILED DESCRIPTION

In the following detailed description, numerous specific details are set forth in order to provide a thorough understanding of the embodiments. However, it will be understood by those of ordinary skill in the art that the embodiments may be practiced without these specific details. In other instances, well-known methods, procedures, and components have not been described in detail so as not to obscure the embodiments.

The present embodiments described herein relate to a safety system that is designed for medical personal such as, but not limited to, doctors, dentists, morticians, hygienists, hygienists, masseuses, physical therapists and respiratory therapists and nurses. In particular, the present embodiments relate to a system to reduce contamination due to aerosols released by the human body in a contamination zone (e.g., a patient in a dental chair, a cadaver in the morgue, etc.). Aerosols may also be created by an air/water syringes, ultrasonic and sonic cleaning systems for cleaning teeth, high speed and slow speed dental handpieces (e.g., drills), cadaver saws, and compressed air delivery for cleaning and drying.

Figure 1:
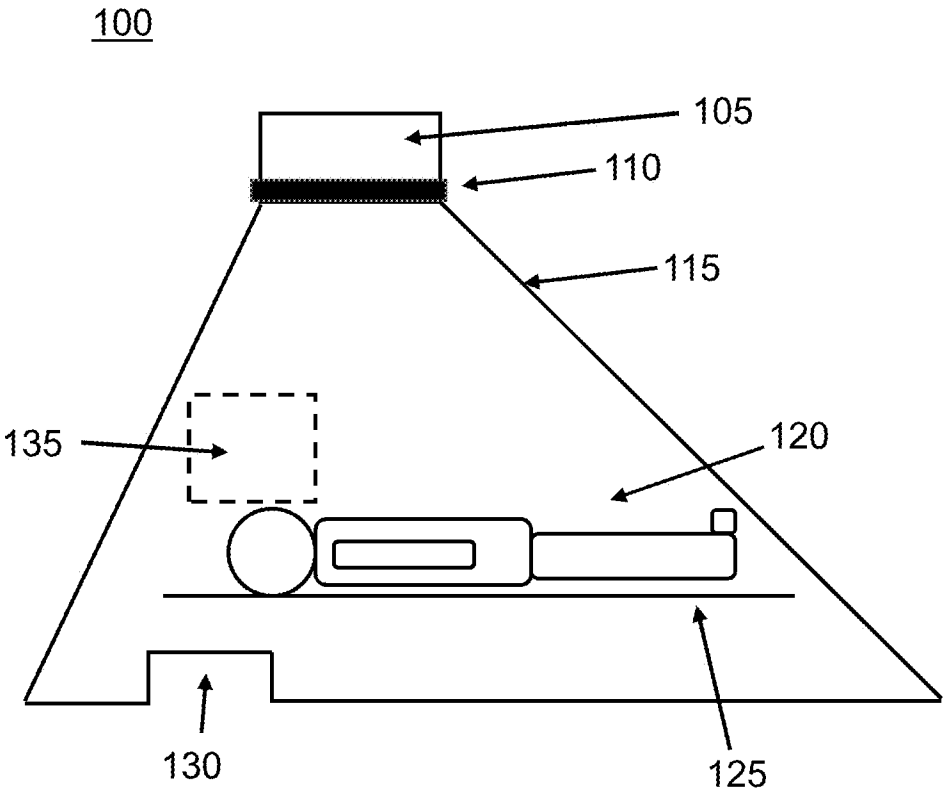
FIG. 1 illustrates an aerosol reduction system in accordance with some embodiments.
Figure 2:
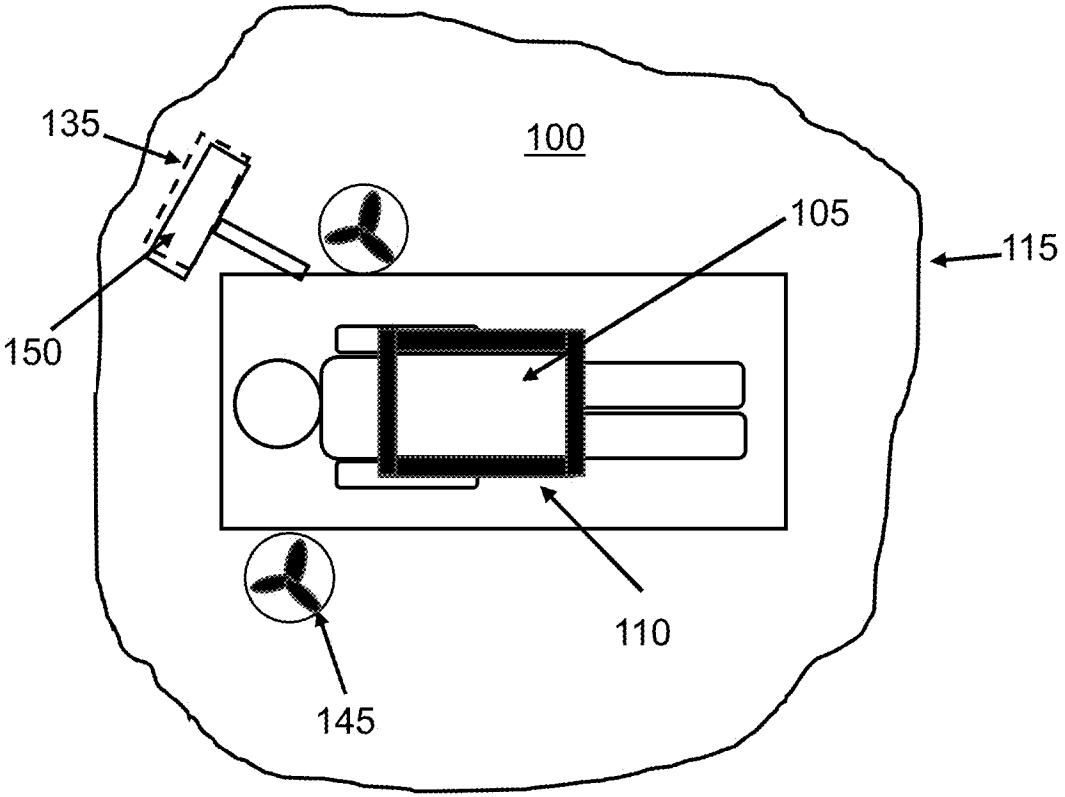
FIG. 2 illustrates an aerosol reduction system in accordance with some embodiments.

Referring now to FIG. 1 and FIG. 2, an aerosol reduction system 100 is illustrated. The aerosol reduction system 100 may comprise an air cleaner 105 (e.g., an air purifier or an air scrubber) and a plurality of disposable curtains 115 circumscribing the air cleaner 105. The air cleaner 105 may be electrically powered and may comprise one or more filters (e.g., HEPA filters) to trap viruses and/or a system to kill pathogens such as, but not limited to, a heater to heat the air, such as, for example heating the air to temperatures in excess of 150 degrees Fahrenheit, an ultra violet light, or a disinfectant such as, but not limited do, a disinfectant spray, liquid or chemical that is capable of killing trapped viruses or pathogens. The air cleaner 105 may further comprise a fan to pull air towards, and into, the air cleaner 105 so that viruses and pathogens are trapped or killed inside the air cleaner 105. For added safety, after the air cleaner 105 kills pathogens received at the air cleaner 105, the air cleaner 105 may exhaust filtered air away from the medical personal (e.g., exhaust the filtered air to the outdoors).

The plurality of disposable curtains 115 may circumscribe the air cleaner 105 and create an airtight seal with the air cleaner 105. For example, the plurality of disposable curtains 115 may be rolled (e.g., in a roll) and housed in a dispenser or holder 110 where the dispenser or holder 110 makes an airtight seal with the air cleaner 105 and each of the plurality of disposable curtains 115 may be pulled from a roll (e.g. a perforated roll) to surround a patient 120 lying on a table 125 such as a flat table or a chair (as illustrated in FIG. 2). An area under each of the plurality of disposable curtains 115 may be defined as a contamination zone and after the patient has left the containment zone, the disposable curtain 115 may be separated from the holder 110 and thrown away. Each new patient may use a new disposable curtain 115. In some embodiments, the disposable curtains 115 may be comprised of individual curtains (e.g. not in a roll) that are removably coupled to the holder 110 so that after each use, the individual curtains 115 may be removed from the holder 110 and thrown away. The holder 110 may be configured to create an airtight seal with each disposable curtain 115 such as by using a zipper, a series of clips or pressed into the holder.

The plurality of disposable curtains 115 may be comprised of plastic, vinyl or any other clear flexible material. Each of the plurality of disposable curtains 115 may define an opening 135 that is configured to surround a movable and non-disposable window 150 (as shown in FIG. 2). The window 150 may be free standing, connected to a rail system, or may be attached to the bed 125. Each of the plurality of disposable curtains 115 may further define a notch 130 at a distal end of each of the plurality of disposable curtains 115 to allow for a medical personal to insert their arms in the contamination zone while keeping their face shielded by the window 150 and the disposable curtain 115. The notch 130 may be positioned below the opening 135 to make it easier for medical personnel to assist the patient 120. In some embodiments, the notch 130 is aligned with the opening 135.

To further aid in pathogens reaching the air cleaner 105 and from escaping the contamination zone, one or more fans 145 may be disposed below a patient 125 to blow air past the patient 120 and towards the air cleaner 105. Thus, the patient 125 is disposed between the one or more fans 145 and the air cleaner 105. This may also aid in providing fresh air to the patient 120 and keeping the curtain away from the patient. In some embodiments, the fans 145 may be mounted to the mount or mounts that are used to support the window 150.

Figure 3:
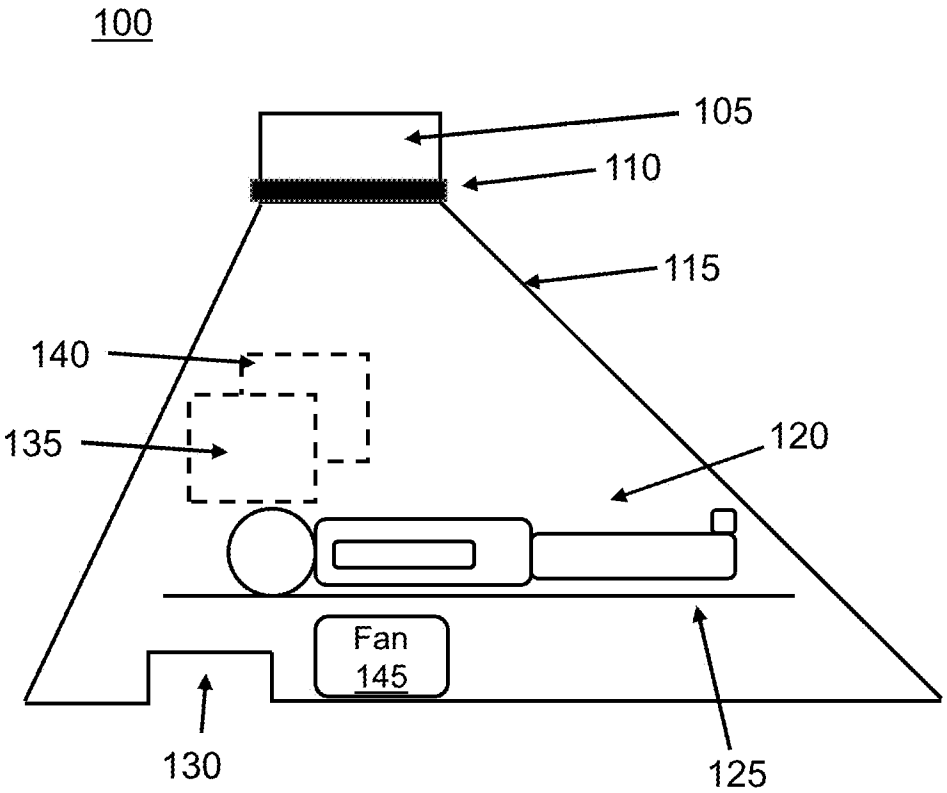
FIG. 3 illustrates an aerosol reduction system in accordance with some embodiments.

Referring now to FIG. 3, an embodiment of the aerosol reduction system 100 is illustrated. As illustrated in FIG. 3, one or more fans 145 may be disposed below the patient 120. In some embodiments, the fans 145 may be coupled to the table 125.

Furthermore, as illustrated in FIG. 3, each of the plurality of disposable curtains 115 may define a first opening 135 that is configured to surround a first movable non-disposable window 150 (not shown in FIG. 3) and a second opening 140 that is configured to surround a second movable non-disposable window (not shown in FIG. 3). The first opening 135 and the second opening 140 may be located on opposite sides of the curtain 115 so that two medical personnel may assist a patient 120 at a same time and also be similarly protected. In this embodiment, a second notch 130 may also be positioned in relation to the second opening 140.

Figure 4:
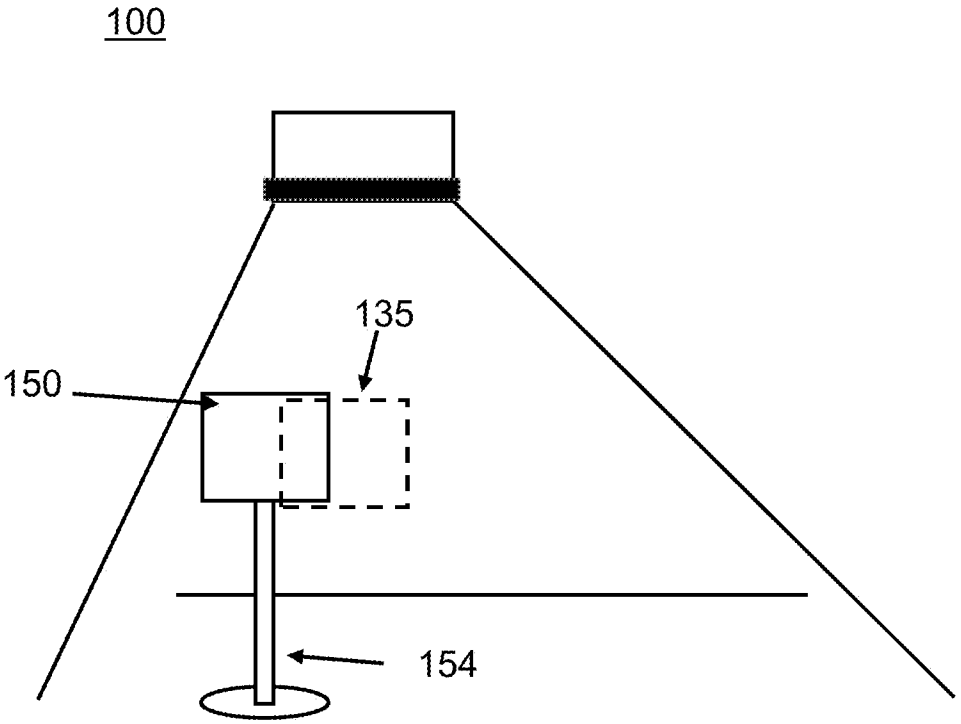
FIG. 4 illustrates a portion of an aerosol reduction system in accordance with some embodiments.
Figure 5:
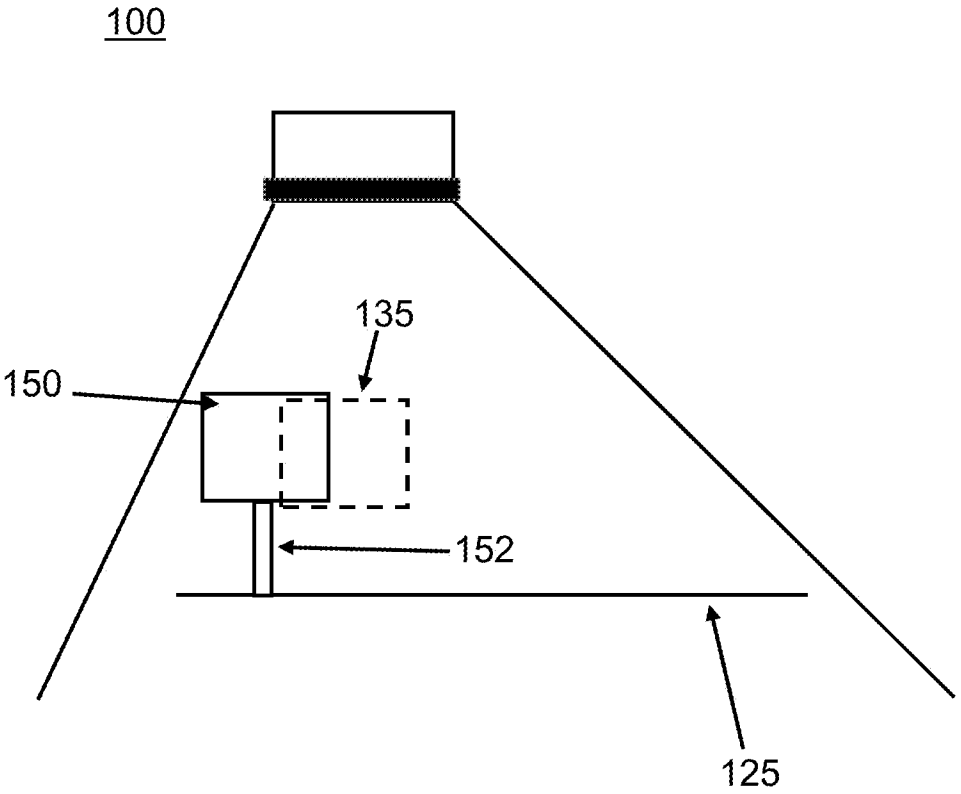
FIG. 5 illustrates a portion of an aerosol reduction system in accordance with some embodiments.

Referring now to FIG. 4, FIG. 5, FIG. 6 and FIG. 7, embodiments of a window 150 that may be used with the aerosol reduction system 100 are illustrated. The window 150 may be comprised of glass, plastic, acrylic, acrylic glass, plexiglass, or other clear materials that are not permeable by aerosols. As illustrated in FIG. 4, the window 150 may be connected to a bracket 152 that is affixed to a table 125. The bracket 152 may be adjustable vertically and horizontally to allow for different heights of medical personal. As illustrated in FIG. 5, the window 150 may be mounted to a stand 154. The stand 154 may comprise a round, square or other flat shaped base that is bolted to a floor. The stand 154 may comprise a removable mounting post to allow for easy disinfecting of the window 150. In some embodiments, the base of the stand 154 may slide on a rail-like track to allow for lateral motion of the window. The stand 154 may further comprise arms that may be vertically adjustable to allow for different heights of medical personnel. In some embodiments, the window 150 may be affixed to the stand 154 or the bracket 152 via a connector that would allow the window 150 to tilt forward or at an oblique angle.

Figure 6:
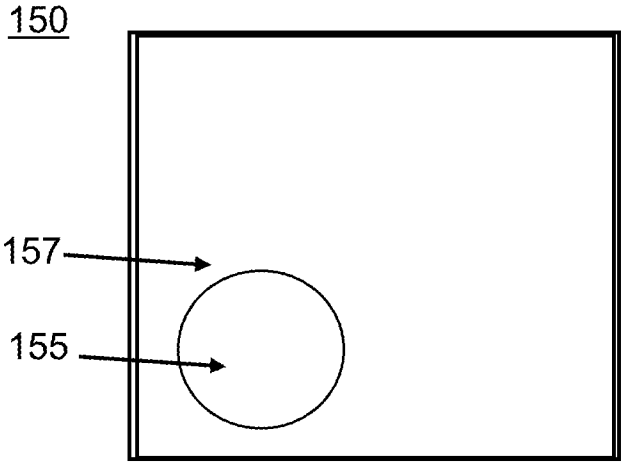
FIG. 6 illustrates a window in accordance with some embodiments.
Figure 7:
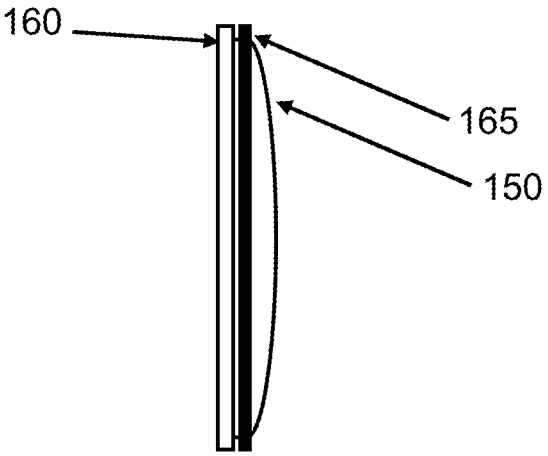
FIG. 7 illustrates a window in accordance with some embodiments.

Referring now to FIG. 6, an embodiment of a window 150 is illustrated. In some embodiments, the window 150 may comprise a magnified portion 155 and a non-magnified portion 157. The magnified portion 155 may function as a magnifying glass to allow the medical personnel to see details associated with a patient more clearly. In some embodiments, the window 150 will not comprise a magnified portion 155.

To secure the disposable curtain 115, and to help create an airtight seal with the window 150, the window 150 may be curved (e.g., have a convex exterior) and include a raised edge 160 so that the disposable curtain 115 may fit snuggly over the curved portion of the window and may be prevented from slipping off the window 150 by the raised edge 160. The disposable curtain 115 may then be secured to the window 150 by a security frame 165. In some embodiments, the security frame 165 may comprise a flexible gasket that fits over the window 150 to press the disposable curtain 115 against a side of the window 150. For example, the flexible gasket may comprise a rubber gasket or a flexible plastic gasket and when placed over the window 150, the flexible gasket pushes the disposable curtain 115 against a side of the window 150 creating an airtight seal. The security frame 165 may be prevented from slipping off the window 150 by the raised edge 160 where the security frame 165 presses the disposable curtain 115 into a side of the window 150 and also presses the disposable curtain 115 against the raised edge 160.

Figure 8:
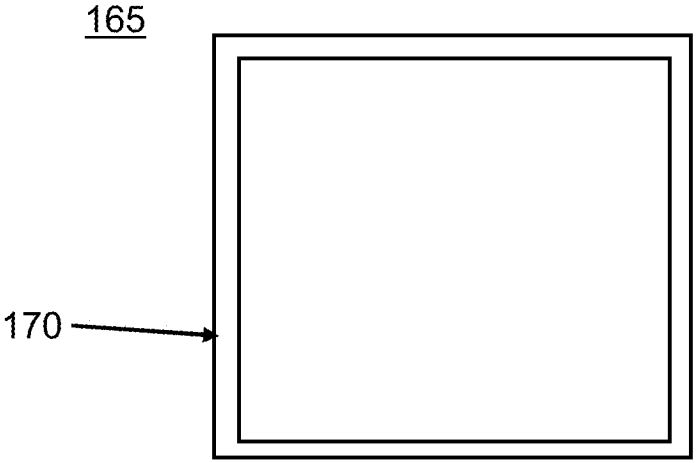
FIG. 8 illustrates a security frame in accordance with some embodiments.
Figure 9:
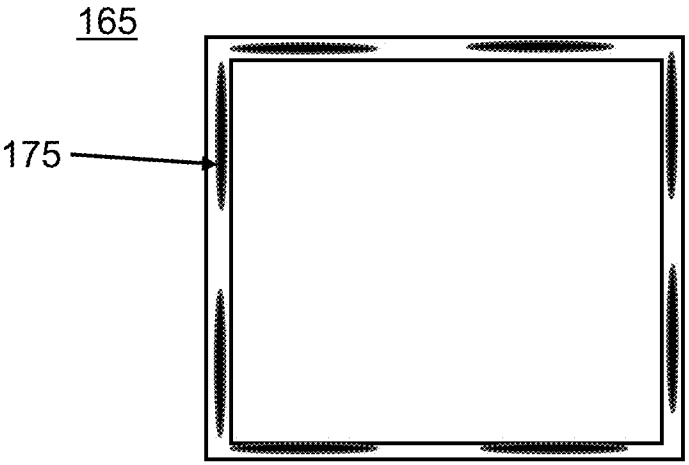
FIG. 9 illustrates a security frame in accordance with some embodiments.

Referring now to FIG. 8 and FIG. 9, in some embodiments, the security frame 165 comprises a ridged structure (e.g., a metal frame) that is fitted to the window and is pushed over the window to secure the disposable curtain 115 to the window 115. In some embodiments, only edges of the ridged structure are pressed against the window allowing for easily securing and removal of the disposable curtain. For example, an outside perimeter 170 of the ridged structure may comprise a smooth surface while an inner surface 175 may comprise a flexible material such as rubber or plastic that flexes to push the disposable curtain 115 against a side and/or raised edge of the window 150. This may create an airtight seal between the inner surface 175 and the window 150 by pressing the disposable curtain 115 between the window and the security frame 165. In some embodiments, the security frame 165 and the raised edge 160 may comprise interlocking channels so that the disposable curtain is pressed within the interlocking channels to create an airtight seal. The curved window 150 may extend beyond the smooth surface 170.

For illustrative purposes, and to aid in understanding features of the specification, an example will now be introduced. This example is not intended to limit the scope of the claims. In some embodiments, a patient that is infected with a pathogen, such as COVID-19, may visit a dentist for a root canal procedure. The patient may sit in a chair and the dentist may pull a disposable curtain down from a roll of disposable curtains. This disposable curtain may surround the patient and the chair creating a contamination zone. The dentist then lines up an opening in the disposable curtain over a window and secures the disposable curtain to the window with a security frame. The dentist may then turn on a fan below the patient and start an air cleaner located above the patient. Air is now flowing towards the air cleaner and expelled pathogens are being sent to the air cleaner. The dentist may then use a notch in the curtain to insert their hands and arms into the contamination zone to work on the patient while staying protected by keeping their face behind the curtain and the window. After the root canal procedure has completed, and the patent has left the office, the dentist may wait a period of time for the air cleaner to full cleanse the air that was surrounding the patient. Once sufficient time has passed, the dentist may remove the disposable curtain from the window and tear off the disposable curtain (e.g., perforations) from the roll. The used disposable curtain may then be thrown away. The window and chair may then be cleansed with a disinfectant and a next patient may receive service.

This written description uses examples to disclose multiple embodiments, including the preferred embodiments, and also to enable any person skilled in the art to practice the invention, including making and using any devices or systems and performing any incorporated methods. Aspects from the various embodiments described, as well as other known equivalents for each such aspects, can be mixed and matched by one of ordinary skill in the art to construct additional embodiments and techniques in accordance with principles of this application.

Those in the art will appreciate that various adaptations and modifications of the above-described embodiments can be configured without departing from the scope and spirit of the claims. Therefore, it is to be understood that the claims may be practiced other than as specifically described herein.

What is claimed:

1. An aerosol reduction system comprising:

an electric air cleaner that includes a fan to facilitate air to flow upwards from a patient of a plurality of patients;

a plurality of disposable curtains circumscribing the electric air cleaner and creating an airtight seal with the air cleaner, wherein each of the plurality of disposable curtains defines a window opening to surround a movable and convex-shaped window;

the convex-shaped window, separate from the disposable curtain, and disposed on a window mount, separate from the disposable curtain, the convex-shaped window to create an airtight seal with a respective window opening wherein the convex-shaped window is used for multiple patients of the plurality of patients and each of the plurality of disposable curtains is changed to a respective next disposable curtain of the plurality of disposable curtains for each patient of the plurality of patients; and one or more fans disposed below the patient to blow toward the electric air cleaner.

2. The aerosol reduction system of claim 1, wherein the curtain is comprised of a clear plastic.

3. The aerosol reduction system of claim 1, wherein the window is outwardly convex-shaped.

4. The aerosol reduction system of claim 1, further comprising:

a second window to be placed inside a second window opening, wherein each of the plurality of disposable curtains define the second window opening.

5. The aerosol reduction system of claim 1, wherein each of the plurality of disposable curtains comprises a notched opening at a distal end of each of the plurality of disposable curtains.

6. The aerosol reduction system of claim 1, wherein the window comprises a non-magnified portion and a magnified portion.

7. The aerosol reduction system of claim 1, wherein each plurality of disposable curtains is configured to surround the patient laying on a table.

8. An aerosol reduction system comprising:

an electric air cleaner that includes a fan to facilitate air to flow upwards from a patient of a plurality of patients;

a plurality of disposable clear plastic curtains circumscribing the electric air cleaner and creating an airtight seal with the air cleaner, wherein each of the plurality of disposable curtains comprises a window opening to surround a movable and convex-shaped window;

a convex-shaped window, separate from the disposable curtain, and disposed on a stand, separate from the disposable curtain, the convex-shaped window to create an airtight seal with a respective window opening wherein the convex-shaped window is used for multiple patients of a plurality of patients and each of the plurality of disposable clear plastic curtains is changed to a respective next disposable curtain of the plurality of disposable curtains for each patient of the plurality of patients; and one or more fans disposed below the patient to blow toward the electric air cleaner.

9. The aerosol reduction system of claim 8, further comprising:

a second convex-shaped window to be placed inside a second window opening, wherein each of the plurality of disposable curtains comprises the second window opening.

10. The aerosol reduction system of claim 9, wherein each of the plurality of disposable curtains comprises a notched opening at a distal end of each of the plurality of disposable curtains.

11. The aerosol reduction system of claim 9, wherein the convex-shaped window comprises a non-magnified portion and a magnified portion.

12. The aerosol reduction system of claim 9, wherein each plurality of disposable curtains is configured to surround the patient laying on a table.

13. An aerosol reduction system comprising:

an electric air cleaner that includes a fan to facilitate air to flow upwards from a patient of a plurality of patients;

a plurality of disposable clear plastic curtains circumscribing the electric air cleaner and creating an airtight seal with the air cleaner, wherein each of the plurality of disposable curtains comprises a window opening to surround a movable and convex-shaped window and is configured to surround the patient laying on a table;

a convex-shaped window, separate from the disposable curtain, and disposed on a stand, separate from the disposable curtain, the convex-shaped window to create an airtight seal with a respective window opening, wherein each of the plurality of disposable curtains comprises a notched opening at a distal end of each of the plurality of disposable curtains wherein the convex-shaped window is used for multiple patients of the plurality of patients and each of the plurality of disposable clear plastic curtains is changed to a respective next disposable curtain of the plurality of disposable curtains for each patient of the plurality of patients; and one or more fans disposed below the patient to blow toward the electric air cleaner.

14. The aerosol reduction system of claim 13, further comprising:

a second convex-shaped window to be placed inside a second window opening, wherein each of the plurality of disposable curtains comprises the second window opening.

15. The aerosol reduction system of claim 13, wherein the convex-shaped window comprises a non-magnified portion and a magnified portion.

* * * * *